US005433386A

United States Patent [19]

Wieczorek et al.

[11] Patent Number: 5,433,386

[45] Date of Patent: Jul. 18, 1995

[54] FUEL INJECTOR HAVING AN ADJUSTMENT TUBE THAT DISCOURAGES SUPPORT FOR A VAPOR BUBBLE DOME

[75] Inventors: David Wieczorek, Newport News; Gordon Wyant, Hampton, both of Va.

[73] Assignee: Siemens Automotive L.P., Auburn Hills, Mich.

[21] Appl. No.: 265,539

[22] Filed: Jun. 24, 1994

[51] Int. Cl.[6] ..... F02M 51/00

[52] U.S. Cl. ..... 239/585.1; 251/129.21

[58] Field of Search ..... 239/585.1–585.5; 251/129.18, 129.21

[56] References Cited

U.S. PATENT DOCUMENTS

| | | | |
|---|---|---|---|
| 3,567,135 | 3/1971 | Gebert | 239/585.3 |
| 4,313,571 | 2/1982 | Bellicardi et al. | 239/585.5 |
| 5,263,649 | 11/1993 | Babitzka et al. | 239/585.1 |
| 5,275,341 | 1/1994 | Romann et al. | 239/585.4 |
| 5,301,874 | 4/1994 | Vogt et al. | 239/585.1 |

FOREIGN PATENT DOCUMENTS

| | | | |
|---|---|---|---|
| 2528683 | 1/1976 | Germany | 239/585.3 |

*Primary Examiner*—Karen B. Merritt

*Attorney, Agent, or Firm*—Russel C. Wells

[57] ABSTRACT

Dissipation of vapor bubbles in a top-feed, solenoid-operated fuel injector is enhanced by providing the otherwise circular I.D. of the adjusting tube with at least one axially extending radial slot. Different slot patterns are disclosed.

3 Claims, 1 Drawing Sheet

FUEL INJECTOR HAVING AN ADJUSTMENT TUBE THAT DISCOURAGES SUPPORT FOR A VAPOR BUBBLE DOME

FIELD OF THE INVENTION

This invention relates to a solenoid-operated fuel injector of the type commonly used to inject gasoline, or an equivalent volatile fuel, into an internal combustion engine, especially a top-feed fuel injector.

BACKGROUND AND SUMMARY OF THE INVENTION

Certain constraints that are imposed on the engine compartments of automotive vehicles tend to promote the formation of volatile fuel vapor in those components of a fuel injection system which are close to the engine, especially when the engine is hot and not running. These constraints include: smaller, more crowded engine compartments where components are closer to the engine heat and there is less air circulation for removing heat from them; and encasing or shrouding of the engine for noise reduction, protection against road splash, or appearance.

One condition that is rather extreme, but not unusual by any means, is especially conducive to the creation of unwanted fuel vapor in a fuel injector: that condition is referred to as "hot soak", and it occurs in hot temperatures when the vehicle has been left for an extended period of time without the engine running. It is frequently difficult to start the engine under this condition because of fuel vapor that has been created inside the fuel injectors.

Various solutions have been heretofore proposed for overcoming the difficulty of a "hot soak" engine start, but each in one way or another seems to have a disadvantage. A system having bottom feed fuel injectors is much less prone to hot start difficulty because any vapor that does form within the fuel injector does so for the most part at a location that does not obstruct the flow of liquid fuel to the metering orifice. A bottom feed system unfortunately is in general more costly than a top-feed system, and the placement of the metering orifices may be less than optimally related to the desired target point, leaving the potential for undesirable wall wetting by the injections for certain intake geometries.

Other proposed solutions include: running the fuel pump for extended periods of time while the engine is off, running the engine cooling fan, and raising the system fuel pressure, all of which incur added costs and have their own drawbacks.

It has also been proposed to modify individual components, such as reducing the mass of the injector valve body, shrouding the valve body with insulating caps, and molding over the injector body.

The present invention relates to a solution internal to a top-feed fuel injector that enhances the dissipation of hot-start-inhibiting vapor so that a hot engine can be started more quickly with a lesser amount of engine cranking under a hot-start condition. The solution is an economical one since it involves only the modification of the form of an existing part of a fuel injector, namely the adjustment tube that is used to set the bias spring force in a top-feed fuel injector.

The adjustment tube forms a part of the flow path from the inlet through the fuel injector. It has been discovered that the relatively long, narrow nature of the through-hole in the adjustment tube can be prone to sustaining the dome of a vapor bubble that occupies the entire transverse cross-sectional area of the through-hole. In other words, the known geometry of the adjustment tube makes it more difficult to break the surface tension of the vapor bubble, and as a consequence, a bubble, once created, is often difficult to purge through the tube. Vapor in a fuel injector can be purged by flowing out the metering orifice, or it can migrate upwardly, to be replaced by liquid fuel from the fuel supply that feeds pressurized liquid fuel into the top of the fuel injector. Changing the length to diameter ratio of the adjustment tube could alleviate the problem, but such a change could impact adversely on other aspects of the fuel injector construction. Making the length too short could prevent the tube from being satisfactorily crimped to the fuel inlet tube once the adjustment tube has been properly positioned to obtain the desired spring force characteristic; making the diameter larger would increase the overall diametrical dimensions of the fuel injector at a time when the trend is toward smaller and smaller injectors.

The present invention comprises modifying the known adjustment tube by including an axially extending radial slot that runs the full axial length of the adjustment tube so as to interrupt the otherwise full circular diameter of the adjustment tube's through-hole. Importantly, this feature is created without impairing the ability of utilizing the existing technique for axially positioning the adjustment tube within the fuel inlet tube and then crimping the two tubes together once the desired adjustment has been obtained. The invention has the further advantage of being embodied in different structural configurations, several of which will be disclosed herein.

The foregoing, along with further features, advantages, and benefits of the invention, will be seen in the ensuing description and claims that are accompanied by a drawing representing the best mode contemplated at this time for carrying out the invention.

DESCRIPTION OF THE PREFERRED EMBODIMENT

Figure 1:
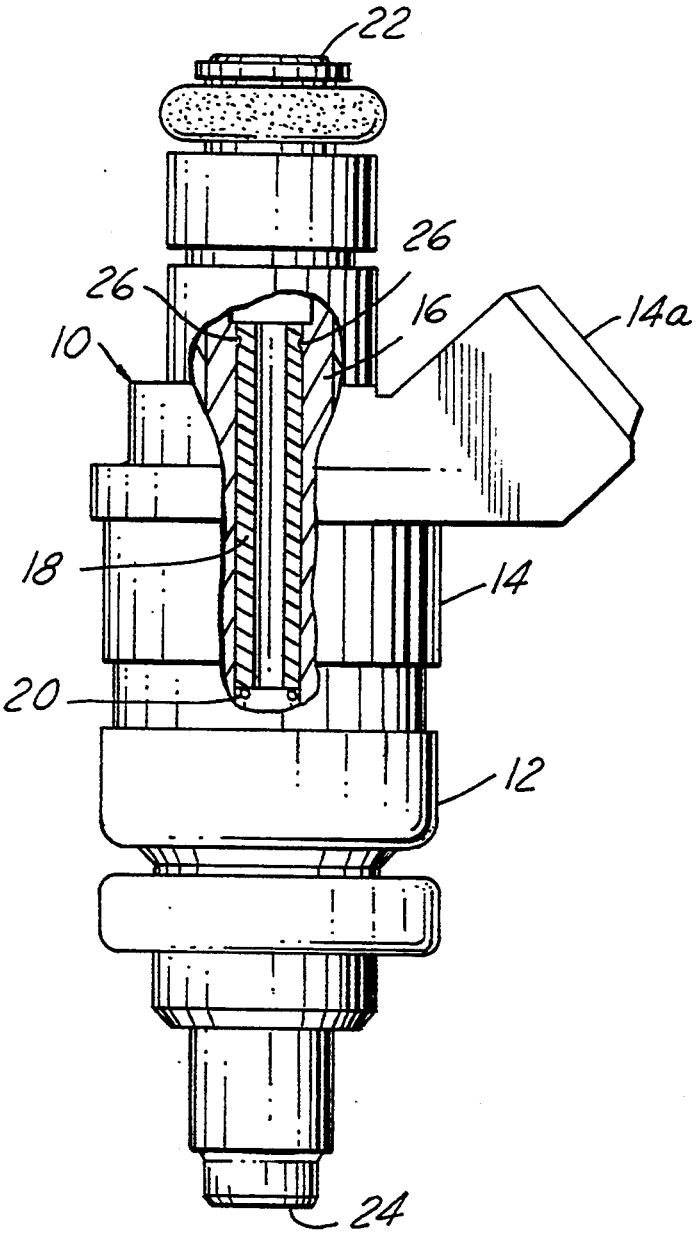
FIG. 1 is a longitudinal view, having a portion broken away for illustrative purposes, of a fuel injector embodying principles of the invention.

FIG. 1 shows a top-feed, solenoid-operated fuel injector 10 of the type to which the present invention relates. Although only that portion of the internal mechanism of fuel injector 10 that pertains to the present invention is shown in FIG. 1, the fuel injector is essentially like that depicted in a number of commonly assigned patents, such as U.S. Pat. No. 5,174,505, for example.

Fuel injector 10 comprises a body 12, a solenoid 14, a fuel inlet tube 16, an adjustment tube 18, and a spring 20. A fuel inlet 22 is provided at the open axial end of inlet tube 16, and fuel is injected from nozzle 24 at the opposite end of the fuel injector. Not shown is that portion of the internal mechanism that includes an armature assembly having a needle valve. When solenoid 14 is not energized, spring 20 resiliently holds the tip end of the needle closed on an internal valve seat (also not shown). When solenoid 14 is energized from an electric control circuit (not shown), the armature assembly that includes the valve needle is displaced axially toward the top of the fuel injector, increasingly compressing spring 20 in the process and concurrently unseating the needle tip from the seat thereby allowing pressurized fuel supplied to inlet 22 to flow through the fuel injector and be injected from nozzle 24. When the energization of solenoid 14 ceases, spring 20 returns the armature assembly to seat the needle tip on the seat and terminate the injection.

It can be seen that adjustment tube 18 is disposed substantially coaxially within fuel inlet tube 16. Except for the inventive feature herein described, tube 18 is nominally circular, having a circular I.D. and a circular O.D. The I.D. of tube 16 that contains tube 18 is also nominally circular, but just slightly larger than the nominal O.D. of tube 18. This deliberately avoids a press-fit of the adjustment tube within the fuel inlet tube so that the manufacturing step of axially positioning the adjustment tube axially within the fuel inlet tube until spring 20 is partially axially compressed to a desired spring force can be performed without encountering a press-fit force that would impair the ability to consistently and expediently obtain proper axial positioning prior to crimping of the two tubes together. Proper crimping of the two tubes together assures that the adjustment tube will not shift within the fuel inlet tube, and hence avoid axial shifting of the adjustment tube that otherwise could have a negative effect on the desired spring calibration that is established by this manufacturing step. The crimp, which is shown at 26 in FIG. 1 (90 degrees out of true position about the main longitudinal axis of the fuel injector for illustrative purposes only), comprises two points of crimping diametrically opposite each other just above the solenoid. This crimp does not impair the integrity of either tube. The crimp is made at 90 degrees to the solenoid's electrical connector plug **14*a*** to avoid interference of the crimping tool therewith.

Figure 2:
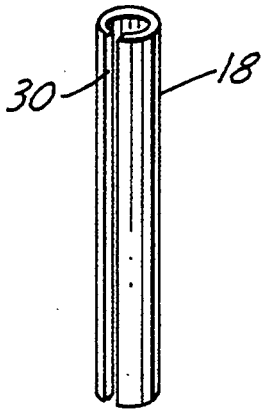
FIG. 2 is a perspective view of a first embodiment of adjustment tube as used in the fuel injector of FIG. 1.

In accordance with principles of the invention, the otherwise full circular I.D. of adjustment tube 18 is interrupted by a single axially extending slot 30 (see FIG. 2) running straight for the full length of the adjustment tube. Slot 30 extends through the full radial thickness of the adjusting tube in this embodiment. This embodiment is convenient to fabricate because it can be made by rolling flat stock to the illustrated shape. Alternatively, the tube could be fabricated by slotting a cylindrical tube.

Figure 3:
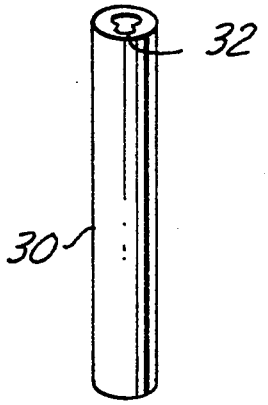
FIG. 3 is a perspective view of a second embodiment of adjustment tube.

In the embodiment of FIG. 3, the slot 32 extends axially the full length of the tube, but radially from the I.D. only partially through the tube wall, stopping short of the tube O.D. The slot is in the nature of a keyway that could be fabricated by broaching the tube.

Figure 4:
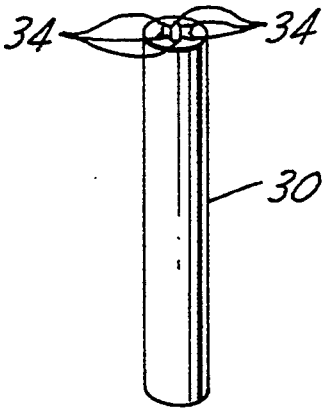
FIG. 4 is a perspective view of a third embodiment of adjustment tube.

In the embodiment of FIG. 4, a plurality of slots 34 are arranged circumferentially spaced about the tube's I.D., running axially the full length of the tube, but stopping radially short of the tube's O.D.

Common to all embodiments of the invention is the fact that the otherwise nominal fully circular I.D. of the adjusting tube is interrupted so that a noncircular cross-section results, without the existing adjusting procedure being adversely impacted. Although the FIG. 4 embodiment appears as a solid tube, it could be fabricated by creating the slots in flat material and then rolling it such that it fits into a cylindrical space.

What is claimed is:

1. A top-feed, solenoid-operated fuel injector for injecting fuel into an engine comprising a fuel inlet tube having a circular inside diameter that is open at an axial end through which fuel enters the fuel injector, the fuel inlet tube extending from the open axial end to pass through a solenoid that is part of an internal mechanism that functions to cause fuel to be ejected from the fuel injector, the mechanism including a spring that must be adjusted at the time of fabrication of the fuel injector to provide a desired spring force characteristic in the fabricated fuel injector, such adjustment of the spring being performed by axially positioning within the fuel inlet tube an adjustment tube having a nominally circular outside diameter that is just slightly less than the circular inside diameter of the fuel inlet tube such that the adjustment tube does not have an interference fit within the fuel inlet tube during such axial positioning but is nonetheless substantially coaxial with the fuel inlet tube, and then once the desired spring force characteristic has been obtained, the two tubes are mechanically joined by a radially directed crimping operation that creates a crimp joining the two tubes, characterized in that the adjustment tube also has a nominally circular inside diameter and comprises at least one axially extending blind radial slot extending from said inside diameter toward the outside diameter but not intersecting the outside diameter and extending the full axial length of the adjustment tube along the inside diameter thereof so as to interrupt the surface of said inside diameter of the adjustment tube in a manner for reducing the surface tension between said inside diameter and the dome of a fuel vapor bubble across allowing the fuel vapor to migrate through the adjustment tube toward the open axial end of the fuel inlet tube.

2. A fuel injector as set forth in claim 1 wherein said at least one slot comprises plural such slots spaced circumferentially apart around said inside diameter.

3. A fuel injector as set forth in claim 2 wherein said plural such slots are arranged in a symmetrical pattern around said inside diameter.

* * * * *